United States Patent [19]

Dorman

[11] Patent Number: 4,944,697

[45] Date of Patent: Jul. 31, 1990

[54] AUTOMOTIVE FUSE CONNECTOR

[76] Inventor: Douglas M. Dorman, 3559 Franklin Rd., Roanoke, Va. 24014

[21] Appl. No.: 433,125

[22] Filed: Nov. 8, 1989

[51] Int. Cl.[5] ..... H01R 13/68

[52] U.S. Cl. ..... 439/621; 337/255; 337/269

[58] Field of Search ..... 439/621, 622; 337/255-264, 268, 269

[56] References Cited

U.S. PATENT DOCUMENTS

| | | | |
|---|---|---|---|
| D. 279,978 | 8/1985 | Inoue et al. | D13/24 |
| 3,497,850 | 2/1970 | Gallo, Sr. | 337/255 |
| 3,535,667 | 10/1970 | Harnish, Jr. et al. | 337/269 |
| 4,372,638 | 2/1983 | Sohler | 439/857 |
| 4,500,162 | 2/1985 | Keglewitsch et al. | 439/830 |
| 4,604,602 | 8/1986 | Borzoni | 337/198 |
| 4,830,631 | 5/1989 | Hsueh | 439/622 |

*Primary Examiner*—Gary F. Paumen
*Attorney, Agent, or Firm*—Richard C. Litman

[57] ABSTRACT

An automotive fuse is provided that allows connection of an external electrical device. The fuse has a hollow housing into which fit two electrical contacts, both having a conventional flat connector on one end. One of the contacts has a female spade type connector at its other end which is accessible by a male spade type connector through an aperture in the housing. The advantage is that it is not necessary to use an adaptor in order to make an external electrical connection.

2 Claims, 1 Drawing Sheet

AUTOMOTIVE FUSE CONNECTOR

BACKGROUND OF THE INVENTION

1. Field of the Invention

The present invention relates to fuses. More particularly it relates to automotive fuses that serve as connection means between an automotive electrical power source and various multiple electrically driven devices in the automobile. The new fuse of the present invention allows for connecting devices without having to use an additional connection means.

2. Description of the Prior Art

The following is a discussion of patents felt to be related to, but in no way disclosing, either singly or in combination, the present invention.

U.S. Pat. No. 4,372,638 issued to Sohler discloses an electrical connector for using the present fuse block of an automobile to make an electrical connection. This connector serves as an adaptor between the fuse block and the outside connecting lead.

U.S. Pat. No. 4,500,162 issued to Keglewitsch et al. discloses a blade type electrical connector for a fuse clip.

U.S. Design Pat. No. 279,978 discloses an ornamental design for a connector housing.

None of the above mentioned patents disclose modifying an existing automotive fuse block to allow an external electrical connection such as for a radar detector or car stereo amplifier to be made. The fuse itself serves as the connector, no outside devices have to be employed to act as adapters.

SUMMARY OF THE INVENTION

The present invention comprises modifying a conventional ATC fuse block having an outer shell and two solid flat contacts disposed within the shell and protruding out, and substituting for one of the contacts a dual flat/female spade contact. An aperture would be placed on the shell opposite the hole where the conventional contact would have protruded. One end of the female spade contact still fulfills its conventional fuse contact function while the other end functions as the female spade connector that would receive a male spade connector from the connection lead of an electrical device.

This new fuse arrangement allows for the hook up of external devices without having to tap directly into the power source of the automobile or having to use adaptors in order to make a connection with the fuse.

Accordingly, it is one object of the present invention to provide an automotive fuse that allows the direct connection of an external electrical device.

It is another object of the present invention to provide an automotive fuse having one contact that has two connection points, one of which is for the connection of the external device.

It is a further object of the present invention to provide an automotive fuse that allows connection of external electrical devices without the use of adaptors.

It is still another object of the present invention to provide an automotive fuse having a housing with three apertures allowing for electrical connections to be made.

These and other objects of the present invention will become readily apparent upon further review of the following specification and drawings.

A DETAILED DESCRIPTION OF THE PREFERRED EMBODIMENT

Figure 1:
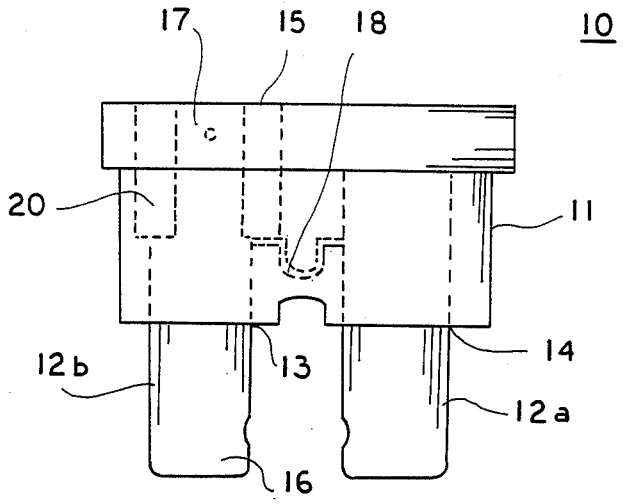
FIG. 1 is a front view of the automotive fuse.

The present invention 10 shown in FIG. 1 comprises an outer plastic shell 11 that houses the two electrical contacts 12*a*, 12*b*. The housing shell 11 has a number of apertures 13, 14, 15 that allow access to the conductive contacts 12*a*, 12*b*. The contacts 12*a*, 12*b* stick out through apertures 13, 14 to serve as a conventional automotive fuse. Aperture 15 is for gaining access to the other end of the contact 12*b*.

Figure 2:
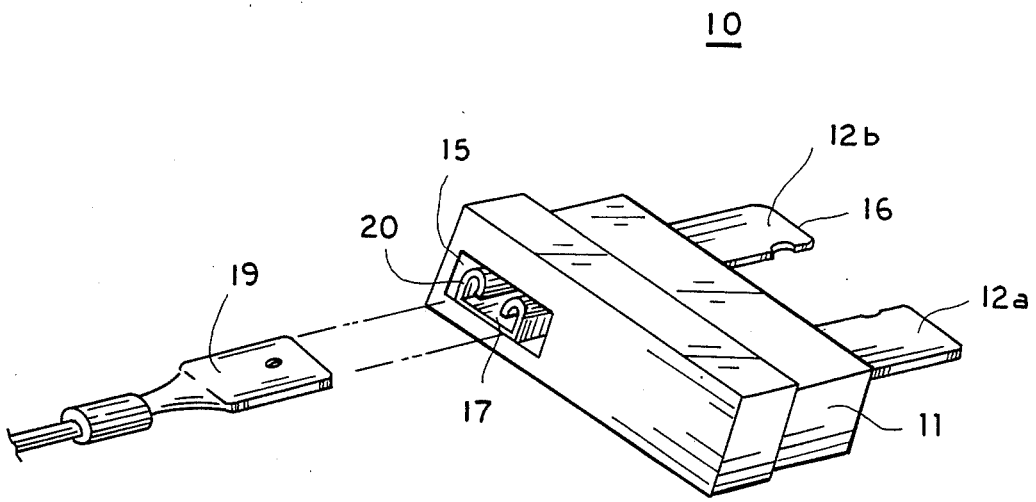
FIG. 2 is an exploded view of the present invention. Similar reference characters denote corresponding features consistently throughout the attached drawings.

The contact 12*a*, best shown in FIG. 2, is a conventional type of flat contact used in this sort of fuse 10. Contact 12*a* would be placed on the positive side of any connection. The other contact 12*b* is a two ended contact, one end 16 being of the conventional flat sort such as on the contact 12*a*, the other end 17 being a female spade type of contact. This contact end 17 has the recessed walls or flanges 20 to hold in the male spade contact 19 as shown in FIG. 2. This female spade contact 17 is accessed through aperture 15 by a male spade 19 contact of an external electrical device such as a car stereo amplifier. This male spade lead 19 can be the ground for any external electrical device.

Connecting the two contacts 12*a*, 12*b* is a current limiter or fusion connector 18. This serves to prevent an overload of current from damaging any electrical systems. This connector 18 is constructed in a known way so that it will burn out in the conventional manner of fuses of this type upon an overload of current or amperage. The current limiter 18 can be constructed to set any desired current limit for the fuse 10.

The housing shell 11 can be constructed from two separate halves which are welded together by known conventional means upon the placement of the contacts 12*a*, 12*b* into one of the halves.

The present invention provides a means to connect directly to a fuse any outside electrical devices without having to use an adaptor. The present fuse 10 can be substituted for a conventional fuse of this sort. The spade type connectors are offered as a more useful example of the type of connector that could be used. It is possible to use any other conventional type of electrical connector.

It is to be understood that the present invention is not limited to the sole embodiment described above, but encompasses any and all embodiments within the scope of the following claims.

I claim:

1. An automotive fuse that allows connection of external electrical devices, including:

a hollow housing shell having three apertures, two of said apertures being adjacent on one side of said housing shell and the third of said apertures being on the other side of said housing shell opposite one of said other two apertures;

one conventional flat conductive contact disposed in said housing shell and through a first one of said apertures;

a second contact having one conventional flat end and a secondary electrical connector disposed on the other end, said second contact disposed in said housing shell with said one conventional flat end disposed through a second of said apertures adjacent said first one of said apertures, said other end being disposed in said housing shell adjacent said third aperture to allow access for a corresponding electrical connector;

wherein said secondary electrical connector is a female-type connector which is adapted to receive therein a male-type electrical connector blade; and wherein a current limiter is connected between said first and second contacts in said housing shell, said current limiter breaking the connection between said first and second contacts upon an overload of current.

2. The automotive fuse according to claim 1, wherein:

said female-type connector and said male-type blade are of the spade type.

* * * * *